US012163345B2

(12) United States Patent
Gates et al.

(10) Patent No.: US 12,163,345 B2
(45) Date of Patent: Dec. 10, 2024

(54) MODULAR VOID FORM STRUCTURE

(71) Applicant: VOIDFORM PRODUCTS, LLC, Englewood, CO (US)

(72) Inventors: John Woodson Gates, Castle Rock, CO (US); Todd Andrew Diehl, Mansfield, TX (US)

(73) Assignee: VoidForm Products, LLC, Englewood, CO (US)

( * ) Notice: Subject to any disclaimer, the term of this patent is extended or adjusted under 35 U.S.C. 154(b) by 640 days.

(21) Appl. No.: 17/230,901

(22) Filed: Apr. 14, 2021

(65) Prior Publication Data

US 2021/0317670 A1 Oct. 14, 2021

Related U.S. Application Data

(60) Provisional application No. 63/010,027, filed on Apr. 14, 2020.

(51) Int. Cl.
*E04G 15/00* (2006.01)
*E04G 9/08* (2006.01)

(52) U.S. Cl.
CPC ..... *E04G 15/00* (2013.01); *E04G 9/083* (2013.01)

(58) Field of Classification Search
CPC ..... E04G 9/021; E04G 9/08; E04G 9/083; E04G 9/086; E04G 9/10; E04G 2009/028; E04G 11/46; E04G 15/00; E04G 15/061; E04B 5/19; E04B 5/21; E04B 5/326; E04B 5/36; E04C 2/322
See application file for complete search history.

(56) References Cited

U.S. PATENT DOCUMENTS 885,158 A 4/1908 Kahn
949,668 A 2/1910 Swinscoe
1,053,256 A * 2/1913 Weakley ..... E04G 11/46 52/378
1,147,000 A 7/1915 Burk
1,621,664 A 3/1927 Gersman
1,677,073 A 7/1928 Cohen
1,701,238 A * 2/1929 Kennedy ..... D21J 7/00 162/410
1,977,260 A 10/1934 Birdsey
2,018,085 A 10/1935 Otte
D160,877 S 11/1950 Moorman
2,732,707 A 1/1956 Ries
2,734,250 A * 2/1956 Thompson ..... E04G 11/46 249/177
2,934,934 A 5/1960 Berliner
2,939,602 A * 6/1960 Grant ..... B65D 85/324 206/521.1
3,185,370 A * 5/1965 Reifers ..... B65D 85/324 206/521.1
3,376,629 A 4/1968 Baumann et al.
(Continued)

FOREIGN PATENT DOCUMENTS

BR 102017018536 A2 * 3/2019
CA 2030080 A1 5/1992
(Continued)

*Primary Examiner* — Ryan D Kwiecinski

(57) ABSTRACT

A void form is composed of molded pulp and includes bottom-facing openings. Fresh concrete placed on top of a substrate material covering the void form structure is formed with a void space underneath that allows soil to expand.

25 Claims, 10 Drawing Sheets

(56) References Cited

U.S. PATENT DOCUMENTS 3,527,004 A * 9/1970 Sorensen ..... A63H 33/04 446/85
3,543,458 A * 12/1970 Guritz ..... E04B 5/48 249/176
3,592,437 A * 7/1971 Dashew ..... B28B 7/0038 249/63
3,632,078 A * 1/1972 Dashew ..... B28B 7/34 249/176
3,863,414 A 2/1975 Dunn, Jr.
3,908,323 A 9/1975 Stout
3,931,952 A * 1/1976 Dashew ..... B28B 13/06 249/177
4,289,818 A * 9/1981 Casamayor ..... A47K 3/284 52/287.1
4,418,463 A 12/1983 McNeill
4,487,000 A 12/1984 Ball
4,611,450 A 9/1986 Chen
4,615,166 A 10/1986 Head
4,653,959 A 3/1987 Richard
5,044,821 A * 9/1991 Johnsen ..... E02D 31/02 52/169.5
5,056,281 A 10/1991 McCarthy
5,230,943 A * 7/1993 Pregont ..... B65D 81/09 428/903.3
5,306,100 A * 4/1994 Higginbotham ... B65D 90/0073 428/116
5,352,064 A * 10/1994 Carruthers ..... E04G 9/10 404/74
5,397,096 A * 3/1995 Nelson ..... E04G 11/46 249/176
5,421,968 A 6/1995 Bennett et al.
5,527,590 A 6/1996 Priluck
D375,574 S 11/1996 Pickett
5,782,049 A 7/1998 Gates et al.
5,799,455 A 9/1998 Gates et al.
5,915,884 A 6/1999 Gates et al.
5,962,150 A 10/1999 Priluck
6,003,283 A 12/1999 Hull
6,116,568 A * 9/2000 Rosenblat ..... E04G 9/021 249/185
6,289,638 B1 * 9/2001 Vasseur ..... E02D 31/10 248/548
6,794,017 B2 9/2004 Comeau et al.
7,131,239 B2 11/2006 Williams
7,353,641 B2 * 4/2008 Yoshii ..... B28B 7/28 52/577
7,424,967 B2 9/2008 Ervin et al.
7,458,186 B2 * 12/2008 Carter ..... E04B 1/3211 52/80.1
7,543,419 B2 * 6/2009 Rue ..... E04C 2/384 52/630
D618,366 S 6/2010 Allmann
7,771,814 B2 * 8/2010 Grimble ..... B27N 5/00 249/55
D623,773 S 9/2010 Ryan
8,245,469 B2 8/2012 Rubel et al.
8,353,640 B2 * 1/2013 Sawyer ..... E04F 15/02194 404/31
8,646,239 B2 2/2014 Rulon
8,793,877 B2 8/2014 Kim et al.
9,038,342 B2 * 5/2015 Hassan ..... E01C 3/006 52/403.1
9,212,485 B2 12/2015 Wolynski et al.
9,273,476 B2 * 3/2016 Hoyle ..... E04G 9/086
9,732,478 B2 8/2017 Kriech et al.
9,739,018 B2 8/2017 Kriech et al.
9,771,728 B2 * 9/2017 Gilpin ..... E02D 27/00
9,797,147 B2 10/2017 Turner
9,803,329 B1 10/2017 El-Sheikhy et al.
10,000,938 B2 6/2018 Gilpin et al.
10,060,080 B2 8/2018 Kriech et al.
10,066,404 B2 * 9/2018 Parodi ..... E04G 15/061
10,184,253 B1 1/2019 Ryan
10,239,228 B2 * 3/2019 Hertz ..... B28B 19/003
10,267,012 B2 * 4/2019 Turner ..... E02D 29/10
10,364,535 B2 7/2019 Kriech et al.
10,428,467 B2 * 10/2019 Chung ..... D21H 21/16
D883,805 S * 5/2020 Abdelnour ..... D9/761
11,293,179 B2 * 4/2022 Heath ..... B29C 64/106
11,851,880 B2 * 12/2023 Rajkovic ..... E04C 5/20
2003/0161685 A1 8/2003 Vasseur
2005/0011152 A1 * 1/2005 O'Grady ..... E04G 9/086 52/364
2005/0055926 A1 3/2005 Ben-Lulu
2007/0051069 A1 3/2007 Grimes
2007/0214740 A1 * 9/2007 O'Grady ..... E04B 5/326 52/577
2009/0242731 A1 * 10/2009 Dinkins ..... E01C 9/004 249/83
2010/0084540 A1 * 4/2010 Talley ..... E04G 15/061 249/1
2011/0120036 A1 * 5/2011 Wignall ..... E04B 5/43 249/188
2011/0120995 A1 * 5/2011 Landry ..... B65D 1/36 229/407
2011/0305526 A1 12/2011 Turner et al.
2012/0297701 A1 * 11/2012 Oakley ..... E04G 9/021 52/340
2013/0313740 A1 * 11/2013 Gilpin ..... E04G 9/086 249/1
2014/0300026 A1 * 10/2014 Taccolini ..... D21H 19/822 264/129
2014/0311077 A1 10/2014 Firouz
2015/0027071 A1 * 1/2015 Studebaker ..... E04B 5/29 52/223.6
2016/0115698 A1 * 4/2016 Parodi ..... E04G 17/00 249/188
2016/0262843 A1 * 9/2016 Sellers ..... A61B 50/33
2017/0241100 A1 * 8/2017 Turner ..... E02D 29/10
2017/0275903 A1 * 9/2017 Gilpin ..... E02D 27/00
2018/0030658 A1 * 2/2018 Chung ..... D21H 17/56
2018/0112389 A1 * 4/2018 Lake ..... E04B 1/4114
2020/0354918 A1 * 11/2020 Cook ..... E04B 5/36
2021/0317670 A1 * 10/2021 Gates ..... E04G 9/083
2022/0145647 A1 * 5/2022 Armstrong ..... E04G 11/46

FOREIGN PATENT DOCUMENTS

CA 2041324 A * 10/1992 ..... E04G 9/10
CA 1314681 C 3/1993
CA 2282109 A1 * 3/2001 ..... E02D 27/01
CA 2373217 A1 8/2003
CA 2502047 A1 9/2005
CA 2282109 C 12/2005
CA 2232091 C 5/2006
CA 2236443 C 9/2006
CA 2231346 C 10/2006
CA 2231707 C 1/2007
CA 2607539 A1 * 5/2008 ..... B27N 5/00
CA 2431614 C 12/2010
CA 2662214 C 3/2012
CA 2607539 C 12/2013
CA 2916214 A1 12/2013
CA 2742434 C 1/2014
CA 2923039 A1 9/2016
CA 3029299 A1 * 3/2019 ..... E02D 27/01
CA 3023745 A1 5/2019
CN 202023295 U 11/2011
CN 113323381 A * 8/2021
EP 1570967 A2 * 9/2005 ..... B28B 23/0068
ES 2530595 A1 * 3/2015 ..... E04B 5/21
JP 2002-097742 A 4/2002
WO WO-2005061804 A1 * 7/2005 ..... E04B 5/21
WO WO-2009067723 A2 * 5/2009 ..... B28B 7/164
WO WO-2013192141 A2 * 12/2013 ..... B28B 23/0068
WO WO-2014196878 A1 * 12/2014 ..... E04B 5/21

* cited by examiner

MODULAR VOID FORM STRUCTURE

TECHNICAL FIELD OF THE INVENTION

The present invention relates to modular void forms for construction.

BACKGROUND OF THE INVENTION

Because some soils expand as they absorb moisture, it is a common practice in concrete construction to create a void space under a structure, such as a building foundation, to isolate the concrete and accommodate soil movement. Void forms are positioned on graded soil, a substrate covering is placed over them to span the gaps between supporting elements, and then reinforcing steel and fresh (i.e. plastic) concrete is placed on top. The void forms temporarily withstand the weight of the concrete until the concrete and reinforcing steel become self-supporting across drilled piers, grade beams, or other load-bearing elements. As the concrete sets, the void form material absorbs humidity and moisture inherent in the surrounding soil and becomes non-structural. This effectively creates a void space into which the soil can expand with tremendous uplift pressure and not displace or damage the foundation. The most effective and desirable void form designs are those that are sufficiently strong enough to support the working load of the concrete placement without resisting additional forces thereafter. Void forms that are too strong can actually transfer the energy from expansive soils into the structure above, which naturally defeats their intended purpose. Void forms can also be used beneath or within a foundation system to provide hollow chases for running wires and pipes or to reduce the concrete volume and weight.

Void forms that are designed to accommodate soil expansion are typically constructed from molded pulp, fiberboard, or corrugated paper materials that will become non-structural over time through the absorption of moisture. In their original dry condition, such void forms are sufficiently strong enough to support the fresh (i.e. plastic) concrete load placed over them. Degradation weakens the void forms, so that they can deform under the pressure of the expanding soil, preventing the void forms themselves from functioning as structural components that transfer damaging energy from expanding soil into the building structure above.

Moisture content changes in some soils having expansive clays will cause them to repeatedly expand and contract—sometimes up to twelve inches or more. The specified height of the void space formed under a concrete structure will vary with the expected soil upheaval. This is called "potential vertical rise (PVR)" or often simply "swell potential". For soil that is less expansive, a void space with a shorter height may suffice. When more soil upheaval is expected (higher swell potential (PVR)), a taller void space is required. Pre-construction soil analysis can provide the structural engineer with the expected soil movement, allowing him or her to select a void space of an appropriate height. Depending on the geographical region in which the project is located, as well as the footprint of the project, multiple soil types having different swell potentials (PVRs) may be found on the same construction site. Therefore, different height requirements for void spaces on a project are not uncommon. This requires the contractor to purchase void forms of varying heights for a single job.

Void forms that are designed to be weakened by moisture may partly compress as the soil expands somewhat. In some cases, they can even dry out again if the soil loses moisture content and retreats. Some void forms regain their strength as they dry out, hardening to such sufficient rigidity that they act as a structural member. Such void forms, even when partly compressed, will transmit energy from the upheaving soil into the building structure above and cause damage.

One example of a void form is described in U.S. Pat. No. 10,267,012 to Michael Turner for a "Plumbing Void Construction Unit". This patent, which is owned by the applicant of the present application, describes a water-resistant structure that creates space beneath concrete structures for the passage of plumbing and electrical lines. U.S. Pat. No. 9,273,476 to Hoyle for a "Modular Void Form" describes modular void forms of various shapes that can be assembled to form closed structures. U.S. Pat. No. 5,352,064 to Carruthers et al. for a "Collapsible Spacer" describes various spacers that support a planar base onto which concrete is placed. When the ground heaves, the spacers can be crushed, leaving the concrete on the base undisturbed. Canadian Patent Publication No. 2030080A1 to McCarthy for a "Void Form" describes a polystyrene void form designed for cold regions that has a cross section composed of a rectangle from which rectangular or triangular projections extend into the soil. U.S. Pat. No. 9,771,728 to Gilpin et al. for a "Device for Forming a Void in a Concrete Foundation" describes a substantially planar void form structure formed as an array of cylindrical channels. The Gilpin form is composed of molded pulp that can be configured to inhibit the penetration of moisture by, for example: (a) including at least thirty percent of wax-coated corrugated paper in the pulp composition; (b) adding wax to the pulp slurry; or (c) coating the molded form.

SUMMARY OF THE INVENTION

An object of the invention is to provide a method and apparatus for providing a void space between a building structure and underlying soil to reduce damage to the building structure caused by soil upheaval.

A preferred embodiment includes a void form panel that exhibits multiple, repeating subunits. Each subunit is open at the bottom to allow soil to expand into a cavity formed by each subunit, as well as the gaps between subunits as they are collapsed. The void form panel is designed to have an appropriate strength that is sufficiently strong enough to support the initial working load of fresh (i.e. plastic) concrete poured above it, yet weak enough to collapse upon compression so as to prevent transmission of energy from soil upheaval into the building structure above. When partly compressed, the module loses its structural integrity and does not regain its mechanical strength upon drying.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more thorough understanding of the present invention and advantages thereof, reference is now made to the following descriptions taken in conjunction with the accompanying drawings, in which.

DETAILED DESCRIPTION OF PREFERRED EMBODIMENTS

Some soils are dynamic—expanding and contracting as they repeatedly absorb moisture and then dry out. The applicant has found that some prior art moisture-resistant void forms weaken as their moisture content increases but then strengthen again as the void forms dry out, even if the void forms have been partly compressed by soil upheaval. Void forms that have regained structural strength after drying may not compress adequately during subsequent soil upheaval and can transmit the damaging energy of the expanding soil into the building structure above.

This restrengthening is a problem with some prior art void forms, like those having cylindrical or conical structural elements, which, when dry, retain a similar strength (i.e. resistance to compression) throughout much of their range of compression (i.e. percent compressed). In other words, when these types of void forms are weakened by moisture and partially compressed, they can dry out again and regain strength that is close to their original uncompressed strength.

Prior art void forms composed of a degradable material, such as molded pulp, fiberboard, or corrugated paper, were typically constructed to be as strong and resistant to moisture as possible. With void forms designed to degrade through the absorption of moisture, those having a higher moisture resistance degrade more slowly. Void forms having high initial strengths and slow degradation rates will transmit destructive energy into the building structure if the ground begins to move before the void forms have sufficiently weakened.

The applicant has determined that any given void form should not simply be as strong as possible, but rather, it should have an appropriate strength—neither too strong nor too weak. It should be just strong enough to support the initial working load, as the concrete is placed, and just moisture-resistant enough to maintain structural integrity while the concrete sets. Such a void form t will collapse as intended if any upheaval load is added, thereby preventing the upheaval load from being transferred into the structure.

A preferred void form loses structural integrity after it is compressed beyond a certain point, yet does not regain strength, even if the soil recedes and the void form dries out. Such a void form type permits rapid degradation due to a low level of moisture resistance. This, combined with its loss of structural integrity and ensuing compression as additional loads are applied, allow these void form types to properly protect the structure as moisture levels change, a dynamic state that causes soils to expand and contract.

Figure 1:
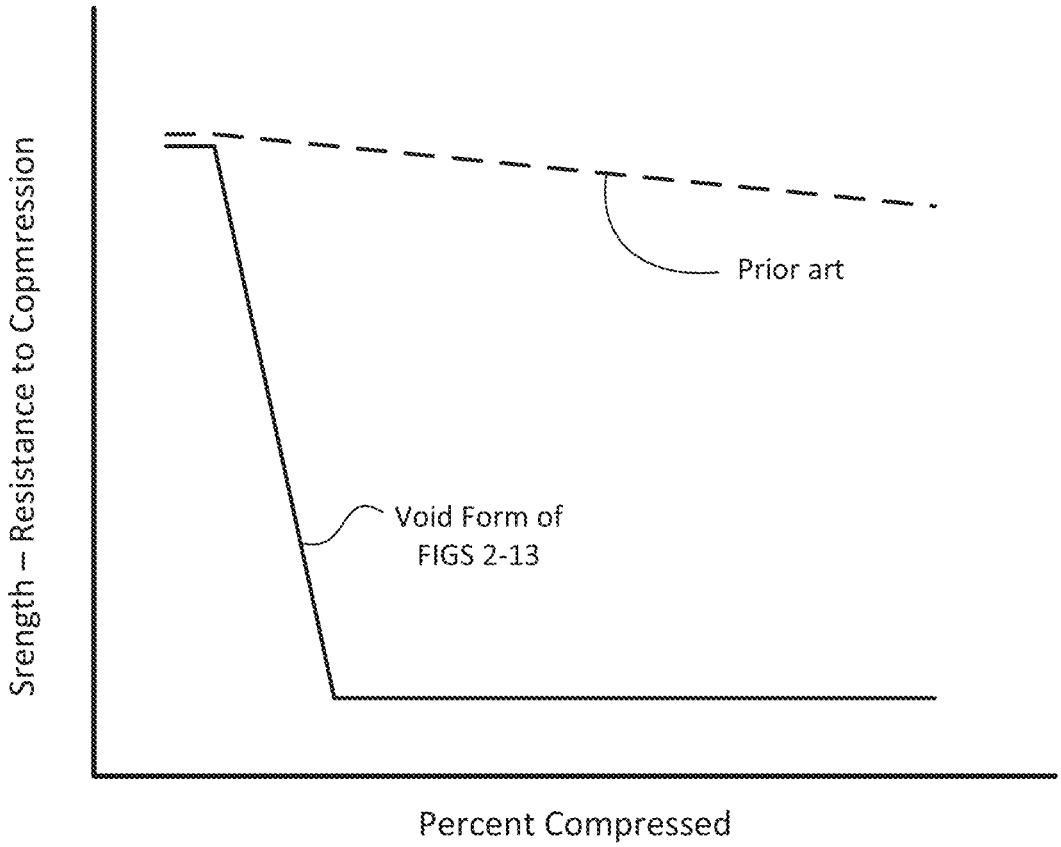
FIG. 1 is an idealized graph showing the compressive strength of void forms (i.e. their resistance to compression) as a function of the degree of compression (i.e. percent compressed)

FIG. 1 is an idealized, qualitative graph that shows a range of void form compression (by percentage). It compares the structural strength of a prior art void form, such as one having a cylindrical or conical design, with that of a void form type as is shown in FIGS. 2-13, relative to the percentage of compression. As can be seen in FIG. 1, the strength of the prior art void form decreases relatively slowly as the void form is compressed. The strength of a void form type as is shown in FIGS. 2-13 decreases very rapidly, immediately after the void form is compressed beyond its maximum sustainable resistance (i.e. past its breaking point). The elongated shapes of the supporting elements for each of these void form types allows them to fold upon compression either in a single fold or in multiple folds like an accordion. The support structure does not spring back when the soil retreats and, unlike prior art cone-shaped void forms, the support structure does not remain stiff after it is sufficiently compressed. In other words, once the void form has been compressed beyond its resistance to uplift pressures as intended, its design will not allow it to perpetually resist additional pressures, making the concrete structure truly isolated and independent of any transfer of energy from expansive soils.

A preferred void form has sufficient moisture resistance to maintain just enough strength to support the static load of fresh (i.e. plastic) concrete until the concrete sets, but insufficient moisture resistance to maintain its structural strength afterwards. While prior art molded pulp void forms typically use a large percentage of water resistant additives such as wax to strengthen them, the formula of the slurry designed for the present void forms allows them to deteriorate much more quickly. It preferably contains a water-resistant additive such as alkyl ketene dimer (AKD) in quantities less than 10%, less than 5%, or less than 2%, with a preferred range of approximately 5% to 2%, depending upon the degree of water resistance required. Naturally, the lower amount of additive that is used, the faster the void form will absorb moisture and deteriorate in strength. By controlling the amount of additive used in the slurry, the void form can be engineered to maintain varying degrees of water resistance, providing greater options for various jobsite applications.

The strength and design profile of any specific void form will depend on the intended load, which is dictated primarily by the thickness of the concrete to be placed. Other considerations, such as the intended application (concrete slab or wall), jobsite conditions, potentially inclement weather, etc. may play a part in the design recommendations. For example, void forms that are designed to support three feet of concrete will obviously require much greater strength than those that are designed to support only eight inches. Furthermore, the void forms designed to support a three-foot-tall grade beam that is only twelve inches wide need not have nearly as much strength and water resistance as those that will support a very large concrete slab that is also three-foot thick. This is due to the extensive humidity that is generated under a large slab due to limited exhaust, especially towards the center of the slab. However, the stronger void form may require more time to absorb moisture and weaken, so careful consideration of multiple factors must be exercised when recommending the proper void form material for any given application.

In designing a void form for strength and water-resistance (or durability) in order to properly perform in a specific application, one must consider many factors. The void form must support not only fresh (i.e. plastic) concrete, but also a substrate covering, reinforcing steel, equipment for placing and finishing the concrete, and live loads imposed by crew members. This is known as the "working load". Since the strength of the void form will begin to decrease as it absorbs moisture from the fresh concrete and surrounding soils, the void form must be designed with an initial dry strength sufficient to support the working load, as well as the appropriate durability to ensure that it can continue to support the concrete as it sets.

The following is a hypothetical, but typical, example of the preceding considerations: Concrete typically weighs approximately 150 pounds per cubic foot, so a layer of concrete that is eight inches thick would weigh approximately 100 pounds per square foot (psf). A void form designed to support an eight-inch-thick slab would preferably have a minimum initial strength of about 500 to 600 psf, which provides a sufficient margin of error to support not only the weight of the fresh (i.e. plastic) concrete, but also the weight of the substrate covering, the reinforcing steel, the equipment for placing and finishing the concrete, and live loads imposed by crew members (i.e. in total, the working load). As the concrete sets, the void form begins to weaken through the absorption of moisture. In a relatively short time, the void form will have rapidly degraded in strength, such that it will be compressed by soil upheaval, rather than maintaining sufficient strength that can transmit energy into the structure, thereby causing damage. In other embodiments, the initial compressive strength of the void form, as well as its durability or water-resistance, can be modified by adjusting the slurry pulp content and moisture-resistant additives contained therein to accommodate a range of working loads imposed by varying construction applications.

The void forms described herein can be manufactured and implemented at a relatively low cost.

Some of the void forms described herein are manufactured as monolithic panels of molded pulp. Each void form panel comprises an array of multiple, repeating cavity subunits. A void form panel may include any number of cavity subunits, although quantities of 8, 16, 20, or 32 subunits are the most common.

Figure 13:
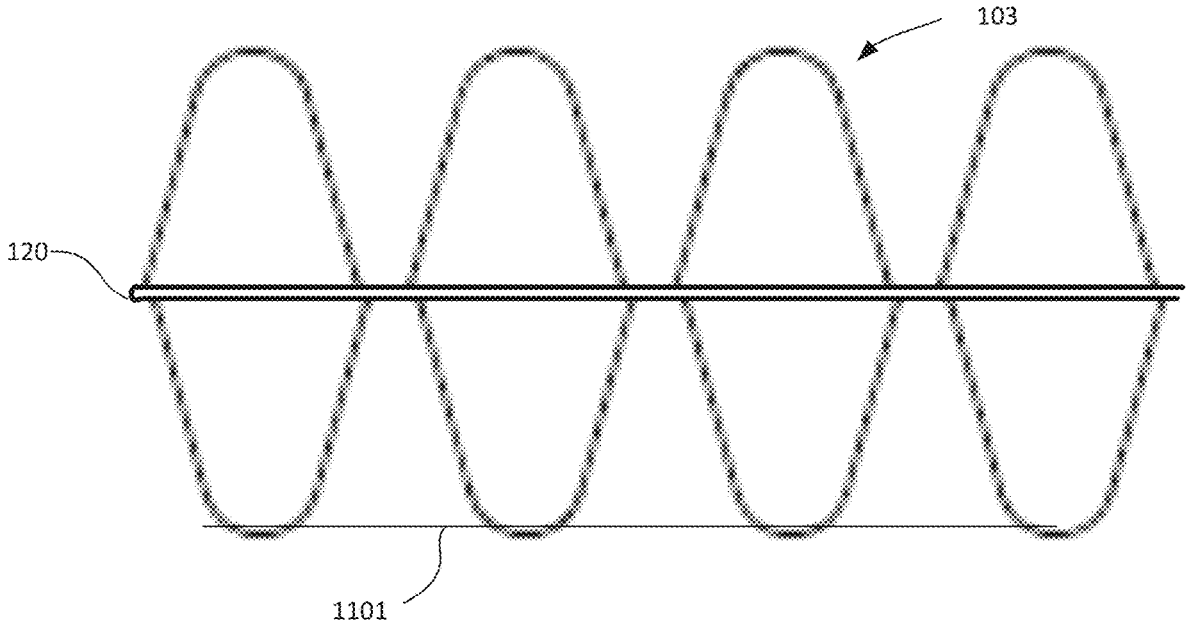
FIG. 13 is a partial view showing a void form panel of FIG. 1 folded onto itself to create void space of greater height.

The profile design of the monolithic molded pulp void form panel limits the stress imposed upon it by distributing the working load of the concrete placement across a network of support elements. For example, a void form panel can be composed of multiple, repeating cavity subunits, each of which is designed to support a portion of the weight of concrete poured above the void form panel. The cavity subunits are connected by a web on only one face of the void form panel to form a structured network of equally spaced supporting elements. Void form panels can be installed with the webbed face either upward (against the substrate covering), or downward (against the soil), as is more commonly recommended. Void form panels can be inverted and stacked in layers to achieve a greater void space height (as shown in FIG. 13). In any case, the void form panels must be covered with some type of rigid substrate upon which the concrete is placed. This can be OSB, plywood, hardboard, or some other solid substrate that will span across the gaps between cavity subunits. Using the installation option where the webbed face of the void form panel is downward (against the soil) as an example, the rounded or angled top closure of each cavity subunit presses against the soffit of the substrate covering it and distributes the working load above the cavity subunit down inclined walls to the ground supported web. Please note that if the void form panel were to be turned over, it would function in similar fashion. However, the webbed face would be against the substrate covering above and the top closures between supporting walls of each cavity subunit would be against the soil. To continue with the first example, though, the walls holding up the top closures of every cavity subunit can be considered supporting portions, while the top closures that connect the walls can be considered connecting portions. The connecting portion of each cavity subunit maintains the supporting portions within it in a somewhat vertical orientation that allow them to support a portion of the total working load. When any applied force exceeds the amount that can be resisted by them, the supporting portions fold and the collapsed cavity subunit is then unable to resist any pressures from that point forward.

A void form subunit having a cavity formed by opposing planar major walls running in a first direction, connected by a top closure and by shorter side walls at the ends, will tend to fold under compression such that the major walls fold in either a single fold or in multiple folds like an accordion. The walls and top closure can be, for example, sinusoidal, barrel shaped, triangular, or any other asymmetrical shape, that provides a folding path of least resistance in which the cavity subunit walls would tend to fold upon compression. The major walls and side walls forming the cavity are of different shapes to facilitate folding.

In other embodiments, the void form has curved sides that form a wave-shaped cross section across multiple, repeating cavity subunits. The wave-shaped cross section may be similar to a sinusoidal curve, although the cross section can vary. In some embodiments, each of the repeating cavity subunits comprises two sets of opposing planar sides, with each of the opposing planar sides within a set tilted towards the opposing side in the set. In some embodiments, an arcuate top closure connects the four planar sides to form a cavity subunit that is closed on top and has a downward-facing opening. In some embodiments, the top edges of two of the opposing sides are horizontal and linear, and the top edges of the other two opposing sides are curved, forming an arcuate top closure. In some embodiments, the transitions from one or both sets of sides to the top closure lack defined top edges, but rather are continuous arcs from each planar side of the cavity subunit to the top closure. In other embodiments, one or both sets of the opposing sides can be vertical. The top closure can be flat or comprised of multiple flat planes, rather than being arced.

A preferred void form is designed to lose its mechanical strength, after the compression amount surpasses its designed capacity for resistance to the compression imposed by the actual working load of concrete placement. Void forms that best exhibit this characteristic use a rotationally asymmetric design throughout its network of supporting elements. Prior art void forms with cylinder- or cone-shaped cavity subunits have circular symmetry in each and tend to resist compression as there is no weaker direction for collapse. Therefore, a void form that is intentionally designed without rotational symmetry can be configured to fold more readily under compression. The cavity subunit of a void form that folds when compressed will exhibit reduced resistance to compression and will not regain strength after drying.

Void forms shown in FIGS. 2-13 lack rotational symmetry, but rather exhibit a translational symmetry between the side walls. That is, a cross section in a plane normal to the long axis of a cavity subunit, such as the cross section shown in FIG. 3, looks identical when the plane of the cross section is advanced along the long axis. The cross section can show, for example, like in FIG. 3, opposing planar sides with an arcuate connecting portion connecting the planar sides at the top and the planar sides curving at the bottom as they attach to the web. The cross section can be sinusoidal, barrel shaped, triangular, or any other shape.

A cross section taken along a plane parallel to the bottom of the void form panel would preferably have the shape of a rectangle. The dimensions of the rectangle will vary with the height above the bottom at which the cross section is taken. In various embodiments, the rotational asymmetry, the translational symmetry, and the rectangular horizontal cross section can facilitate the loss of mechanical strength after a sufficient compression of the void form.

Large void form panels that can still be carried and handled comfortably are much more efficient when covering large areas under concrete slabs than smaller ones. They are also more efficient to manufacture and transport. However, larger void forms may require more field-cutting and configuration to fill narrow or irregular areas, such as those under walls and grade beams.

The void forms described herein are manufactured as large, monolithic panels that can be divided on a construction site into smaller, stable segments of various widths as needed to fill narrow or irregular areas, such as those under walls and grade beams. As each void form panel is comprised of preferably multiple, repeating cavity subunits connected by a web in between them, the web can be severed between the cavity subunits into smaller void form segments that can include a variety of configurations, the only factor for stability being that the substrate covering must be able to span between two or more parallel cavity subunits without falling. In other words, the segment should be able to stand on its own "legs" when flipped over. In some embodiments, the web has an indentation, score, or perforations to facilitate cutting.

In some embodiments, a void form panel can be folded so that the cavity subunits face each other and have their cavities aligned, creating a void form having twice the height of an unfolded void form panel. Folding along the web between the cavity subunits ensures that the cavities align with each other on both halves of the folded structure. A flat or slightly curved web area provides sufficient space between multiple cavity subunits and facilitates the folding. For example, the web may be about ½" wide, 1" wide, 2" wide, or 3", with a preferred width of between approximately 1" to 2" wide, depending on the size of the void form panel and its particular cavity subunits.

Folding a single void form panel, as opposed to stacking two independent ones, provides the advantage that the cavity subunits on opposing sides will be aligned with each other. Some embodiments include an indentation, score, or perforations on the web between cavity subunits to facilitate bending and folding the void form panel back onto itself. Allowing it to be folded onto itself to double its height reduces the number of void form sizes that need to be purchased or maintained in inventory and allows changing the void form height in the field as may be required. It also eliminates the need for a separate layer of substrate material to be placed between layers of void forms when stacking them to achieve greater heights.

A single preferred void form panel preferably covers an area of greater than about 5 $ft^2$, greater than about 10 $ft^2$, greater than about 12 $ft^2$, and preferably greater than or equal to about 15 $ft^2$. One embodiment of a void form panel covers a rectangular area of approximately 45"×48", or about 15 $ft^2$. Prior art molded pulp void forms, such as those described in U.S. Pat. No. 9,771,728 are typically designed to be approximately 2-foot square, covering an area of about 4 $ft^2$.

In some embodiments, with any wax layer having first been removed, corrugated paper is added to the slurry used to form the molded pulp void form. The slurry preferably contains a water-resistant additive in quantities less than 10%, less than 5%, or less than 2%, with a preferred range of approximately 5% to 2%, depending upon the degree of water resistance required.

The molded pulp structure is typically formed using a Type 1 molded pulp process, which can produce walls that typically have a thickness between 3/16" and 5/16", preferably being as close to ¼" thick as possible. Void forms can vary in height with the most typical being 6", 8", and 10" high. The horizontal, external dimensions of void form panels can be, for example, up to approximately 45"×48". They can be fabricated with indentations, scores, or perforations in the web that connects their respective cavity subunits This facilitates breaking or cutting them into smaller sections to accommodate forming void spaces in narrow or irregular areas, such as those under walls and grade beams.

While some prior art void forms include a small hole in each of the cavity subunit surfaces that contact the ground, the applicant has found that such holes are an unnecessary complication, and the void form embodiments described herein form a continuous barrier without holes in any of their surfaces.

Figure 2:
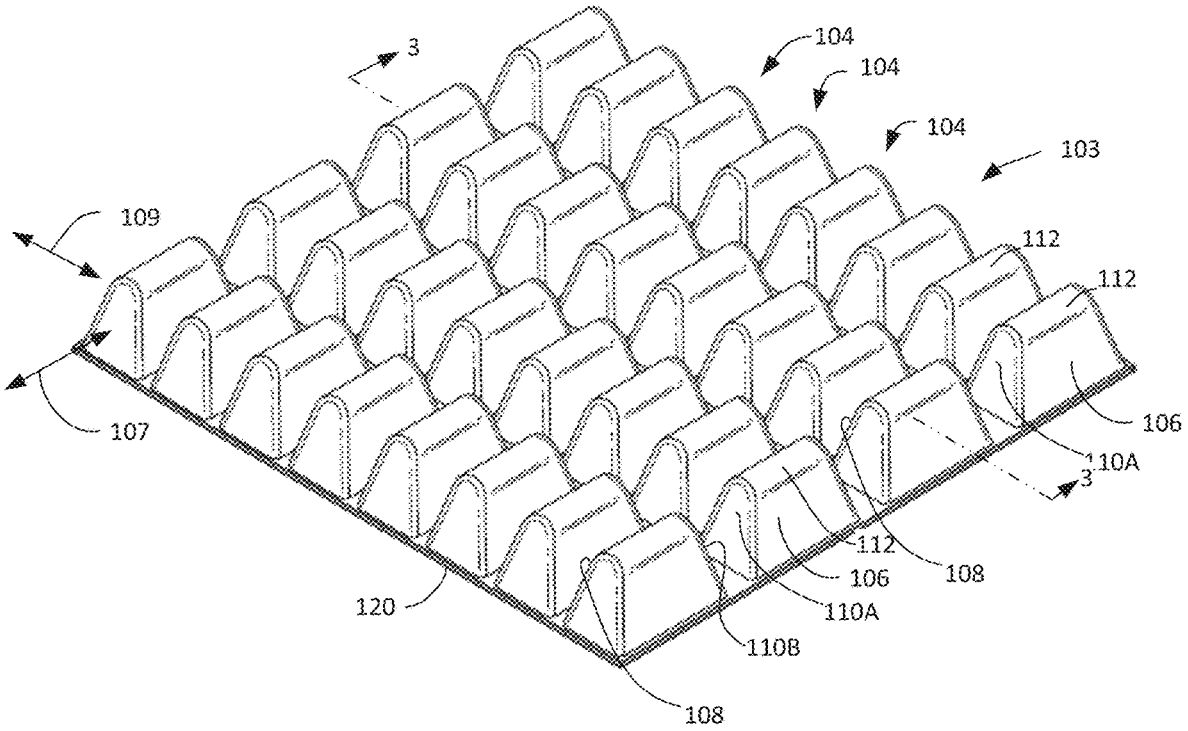
FIG. 2 is a perspective drawing of a void form panel.

FIG. 2 shows a void form panel 103 comprising multiple, repeating cavity subunits 104. A user will typically cover a large area using multiple juxtaposed void form panels 103. Any number of void form panels 103 can be juxtaposed to cover a construction area requiring void space. Multiple void form panels 103 can also be stacked with the cavities 105 (FIG. 3) of alternate layers of void form panels 103 facing each other to provide taller void spaces. Void form panels 103 can be of any shape and can include any number of repeating cavity subunits 104, not all of which need to be identical.

The void form panel 103 can be formed using a molded pulp process, typically a Type 1 molded pulp process. The Type 1 molded pulp process produces desirable properties in the void form, including sufficient strength to support fresh (i.e. plastic) concrete until it sets, while eventually degrading in strength through the absorption of moisture thereafter. The Type 1 molded pulp process typically provides a product with one smooth side and one rough side. In some embodiments, the rough side of the void form panel 103 has subunits with open cavities typically oriented downward (against the soil) when in use, although either side of void form panel 103 can be oriented downward when in use. Regardless of orientation, a substrate covering must be placed over the void forms to span the supporting cavity subunits and carry the reinforcing steel, fresh concrete, crewmembers, and equipment during concrete placement.

Figure 3:
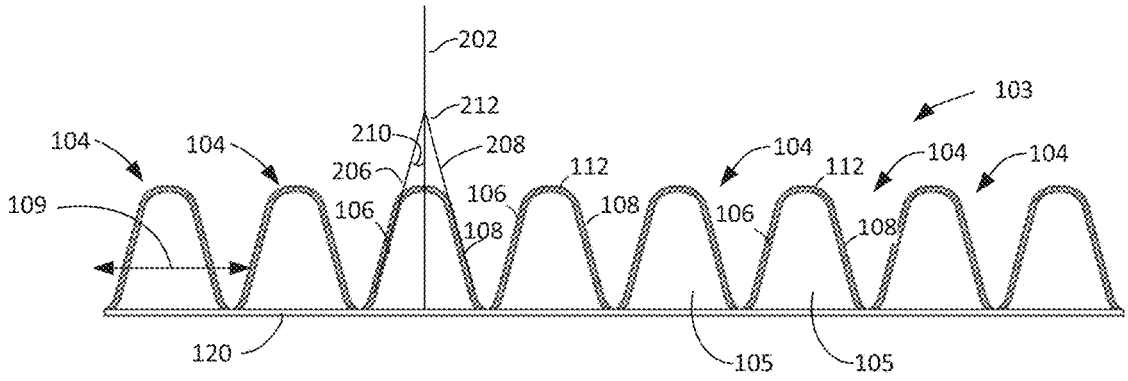
FIG. 3 is a partial, cross-sectional view of the void form panel of FIG. 2.

In the embodiment shown in FIGS. 2 and 3, each of the multiple, repeating cavity subunits 104 forms a downward-facing cavity 105 and has two axes 107 and 109, which preferably are long and short respectively. Each of the multiple, repeating cavity subunits 104 includes a first major wall 106, a second major wall 108, a first side wall 110A, and a second side wall 110B. In a preferred embodiment, a top closure 112 acts to provide a connecting portion between the first major wall 106 and the second major wall 108. The top edge of first side wall 110A and second side wall 110B are curved to match the arc of the top closure 112. The molded void form panel 103 preferably has rounded intersections at intersecting walls.

First major wall 106 lies substantially in a plane 206. Second major wall 108 lies substantially in a plane 208. First major wall 106 and second major wall 108 can depart from their respective planes to form a rounded top closure 112 and/or to form a radius where the major walls 106 and 108 are attached to a connecting web 120, which holds the multiple, repeating cavity subunits 104 together to form void form panel 103. While web 120 is referred to as a separate element, web 120 can be formed by the bottom of walls 106, 108, 100A, and 110B.

For clarity, only a representative few of the repeating cavity subunits 104 and their components are labeled in FIGS. 2 and 3. To close each of the multiple, repeating cavity subunits 104 at the top, first major wall 106 and second major wall 108 may extend substantially in their respective planes to intersect each other to form a top closure 112, or the first and second major walls 106 and 108 may deviate from their respective planes to form a top closure 112 that is not in either plane. Top closure 112 is typically formed integrally with major walls 106 and 108 as part of a monolithic structure, although it could be formed independently and attached. The first major wall 106, second major wall 108, side walls 110A and 110B, and top closure 112 for a downward-facing cavity 120 are configured such that concrete placed onto a substrate covering on top of void form panel 103 is supported above void form panel 103 In use, the ground can expand into the downward facing opening 120, as well as the gaps between cavity subunits 104 upon their collapse, thereby preventing damage to the structure above the void form panel 103.

FIG. 3 is a partial, cross-sectional view taken along a plane through line 3-3 of FIG. 2 and perpendicular to the plane formed by the bottoms of each of the multiple, repeating cavity subunits 104. That is, FIG. 3 shows an edge-on view of first major wall 106, second major wall 108, and top closure 112 as cut through by the sectional plane. To facilitate an explanation of the orientation of the various parts of void form panel 103, FIG. 3 shows an edge of a vertical longitudinal plane 202, an edge of a first plane 206 angled with respect to vertical longitudinal plane 202 and an edge of a second plane 208 angled with respect to vertical longitudinal plane 202. The first major wall 106 is coincident with the first plane 206 and the second major wall 108 is coincident with the second plane 208. First plane 206 and second plane 208 intersect at a line 212, shown end-on in FIG. 3. The top closure 112 shown in FIGS. 2 and 3 is arcuate. The side walls 110 form a sloping triangle truncated at the top and closed by arcuate top closure 112.

The shape of cavity subunit 104 exhibits translational symmetry. That is, the cross section shown in FIG. 3 represents the cross section at any point throughout the length of cavity subunit 104, between the side walls 110A and 110B. The translational symmetry provides a preferred failure mode. As the cavity subunit 104 is compressed beyond its designed resistance to uplift pressure, major walls 106 and 108 will collapse on themselves, each either in a single fold or in multiple folds like an accordion. A cross section of the interior of a cavity subunit 104 taken in a horizontal plane parallel to the web will be a rectangle. The size of the rectangle will get smaller as the cross-section plane moves from the web toward the top of the top closure 112.

The angles 210 of the planes 206 and 208, as well as those coincident with side walls 110A and 110B, respectively, will vary with the height of the void form. Void forms are typically between 4" and 12" high, although heights outside this range are possible. The height of the void form will depend on the swell potential (PVR) of the soil over which they are placed.

In one embodiment, the angle 210 between each major wall and a vertical plane is about 15 degrees. The radius of the arcuate top closure 112 is about ¼ inch. The bottom of the triangular face of side wall 110, rather than coming straight down to form part of web 120 has a radius of about ½ inch. In a preferred embodiment, each of the multiple, repeating cavity subunits is approximately 11 inches long by about 6 inches wide. The top closure 112 typically represents about one eighth or less of the height of the void form panel 103.

Again, with respect to a preferred embodiment, a projection of the top closure 112 onto a horizontal plane measures approximately 2½ inches by 7 inches, and each of the multiple, repeating cavity subunits 104 extends about six inches from the bottom horizontal plane. The angle 210 is about 15 degrees, that is, each of the major walls 106 and 108 are sloped about 15 degrees from the vertical. Side walls 110A and 110B may or may not be sloped at similar angles as the major walls 106 and 108.

The angles of the walls will be different for void forms of different heights to ensure that the void form will lose its strength once compression exceeds its designed resistance to uplift pressures.

Figure 4:
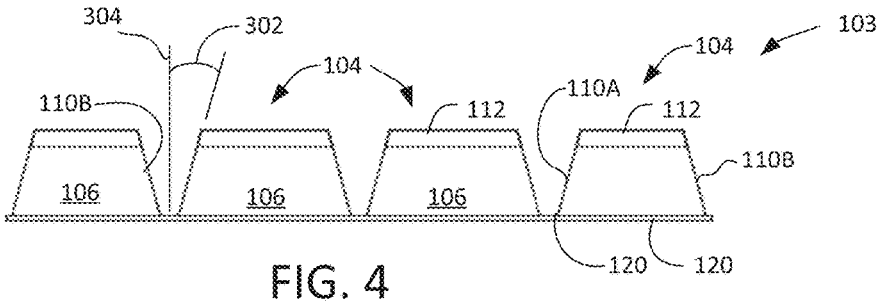
FIG. 4 is a partial front elevation of the void form panel of FIG. 2.
Figure 5:
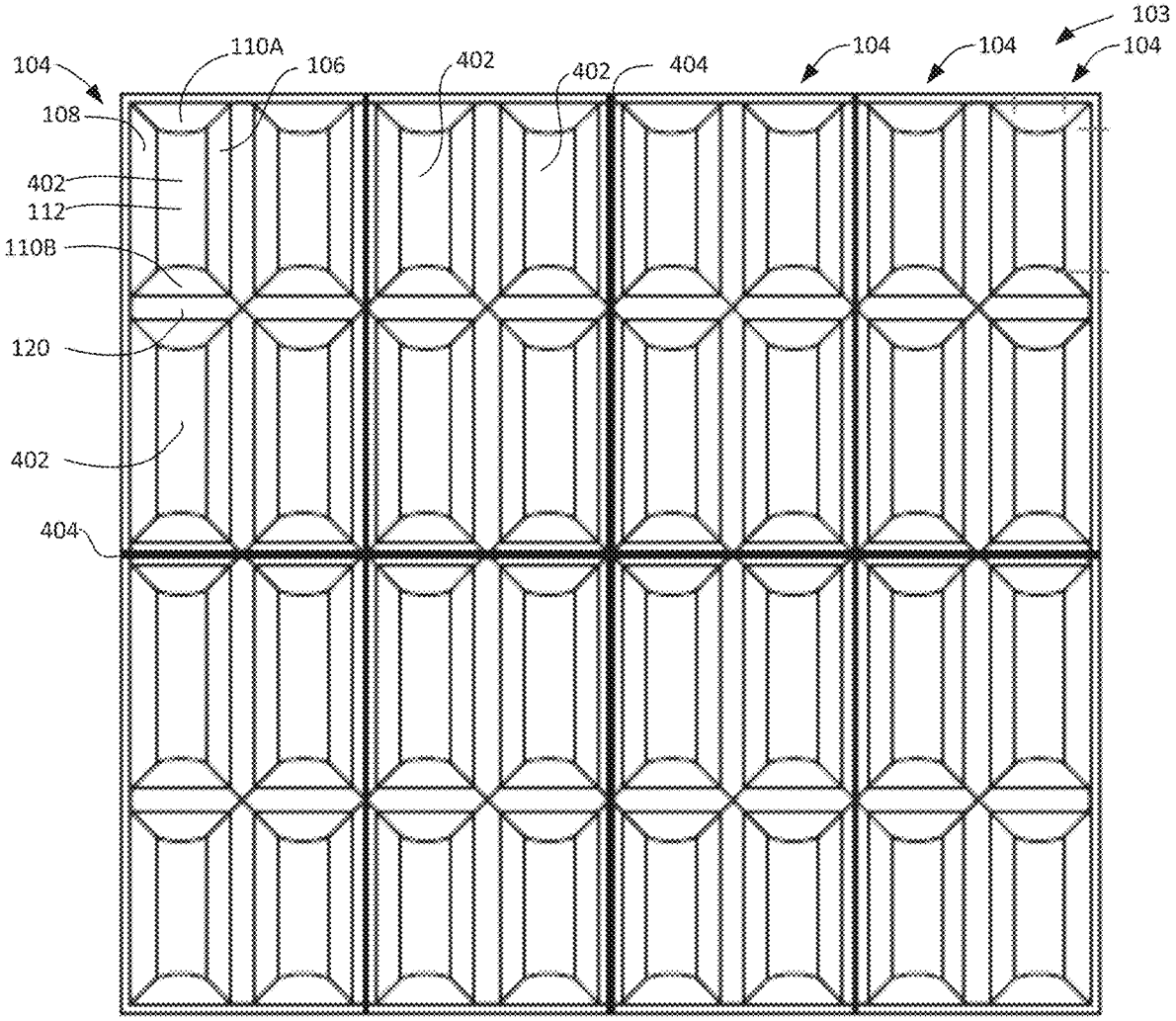
FIG. 5 is a plan view of the void form panel of FIG. 2.

FIG. 4 is a partial front elevation of a portion of the void form shown in FIG. 5. As can be seen from FIG. 4, first major wall 106 forms a sloping trapezoid, bounded at the bottom by web 120 and at the top by top closure 112. Second major wall 108 (not visible in FIG. 4) similarly forms a sloped trapezoid. In one embodiment, the angle 302 between each of the side walls 110A and 110B and a vertical plane 304 that is perpendicular to the vertical plane 202 (FIG. 3) is approximately 15 degrees.

FIG. 5 shows a top view of a void form panel 103 composed of 32 repeating cavity subunits 104. The bottom of each of the multiple, repeating cavity subunits 104 is open, allowing soil beneath the void form panel 103 to expand into not only the cavities 402 formed by first and second major walls 106 and 108 respectively, side walls 110A and 110B, and top closure 112, but also the gaps between cavity subunits when they are compressed beyond their designed resistance to uplift pressures. Grooves 404 facilitate dividing void form panel 103 into smaller void form segments by cutting void form panel 103 along groove 404. Void form panel 103 can also be folded along groove 404 such that cavities 402 of the two folded halves face each other, thereby making a void form panel 103 having double the height of unfolded void form panel 103.

Figure 6:
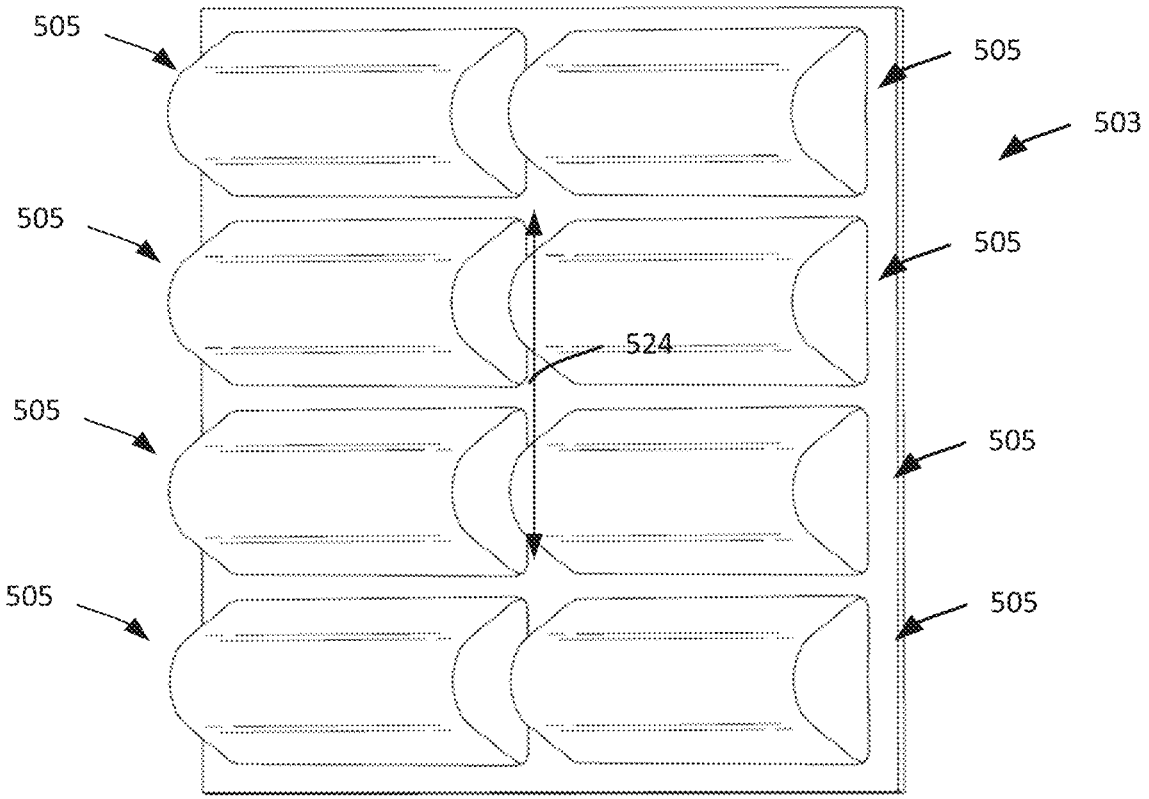
FIG. 6 is a perspective drawing of another void form panel.
Figure 7:
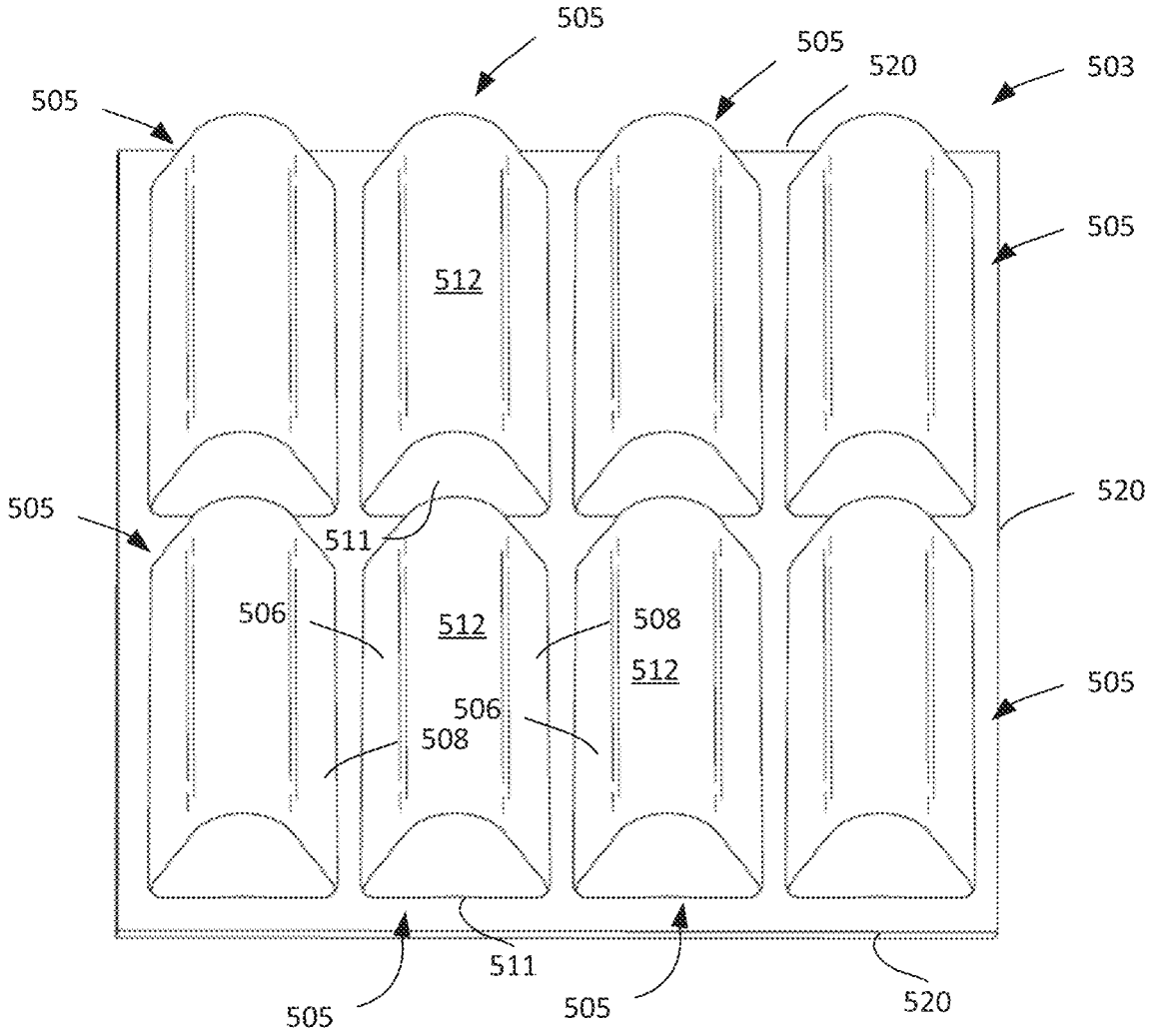
FIG. 7 is a plan view of the void form panel of FIG. 6.

FIGS. 6 and 7 are top isometric views, perpendicular to each other, of another void form panel 503 comprising a two-by-four array of repeating cavity subunits 505. Each of the cavity subunits 505 are essentially identical to each other, although in some embodiments, the cavity subunits 505 may differ from each other. In FIG. 7, each cavity subunit 505 includes a first major wall 506, a second major wall 508, a first side wall 510 (FIG. 8), and a second side wall 511. All comprising components are labeled on one specific cavity subunit 505, and some on various other cavity subunits 505. However, most remain unlabeled for clarity. For each subunit 505, a top closure 512 connects a first major wall 506, a second major wall 508, a first side wall 510 (FIG. 8) and a second side wall 511 to form an enclosed cavity having a bottom-facing opening.

A base or web 520 connects the multiple, repeating cavity subunits 505 to form a complete void form panel 503. Web 520 extends between the multiple, repeating cavity subunits 503 and also extends around the edge of void form panel 503. When multiple void form panels 503 are juxtaposed, to form a larger void form structure (not shown), the edges of the webs from adjacent void form panels 503 can, but need not, overlap. Web 520 is sufficiently wide to facilitate cutting void form panel 503 into smaller void form segments.

Figure 8:
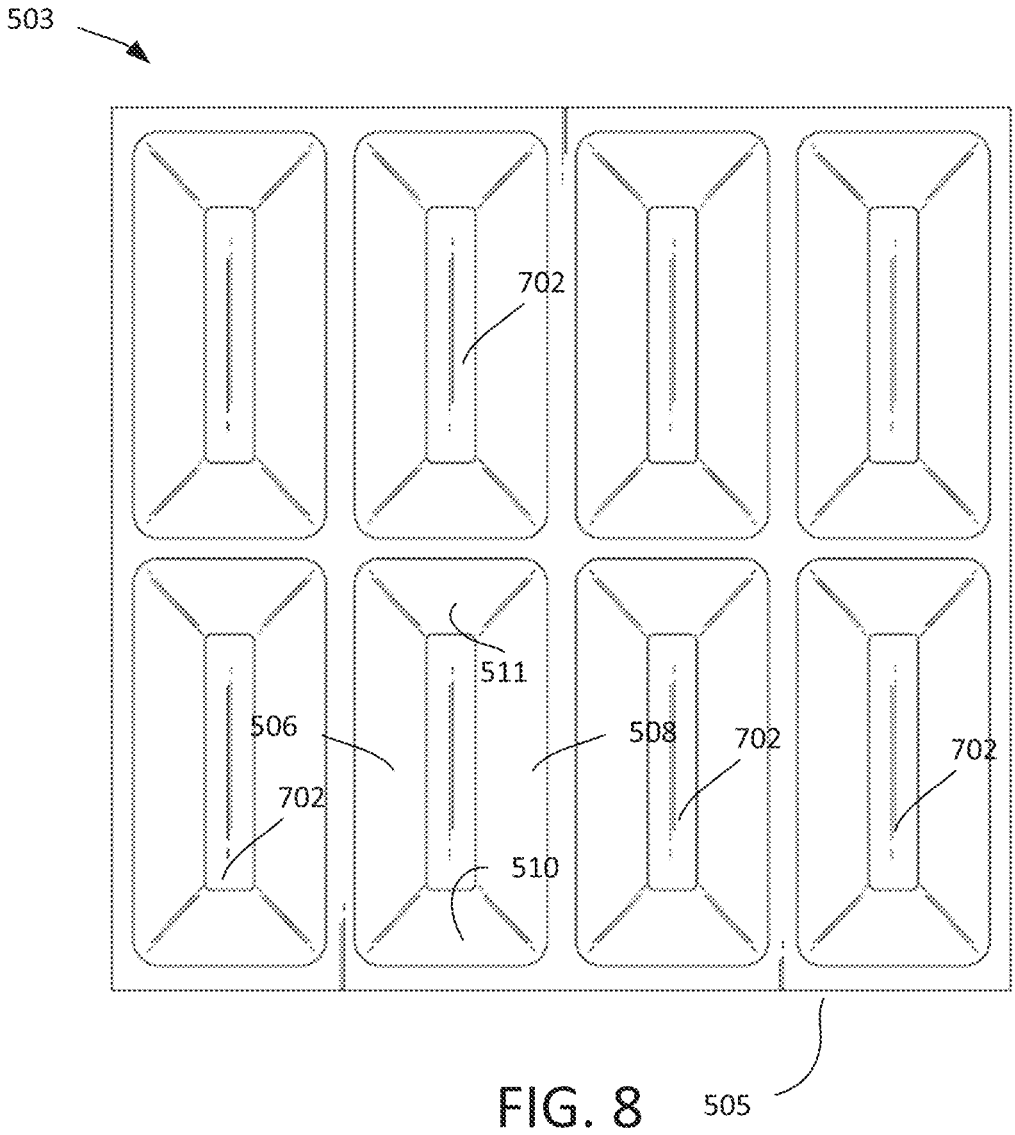
FIG. 8 is a bottom view of the void form panel of FIG. 6.
Figure 9:
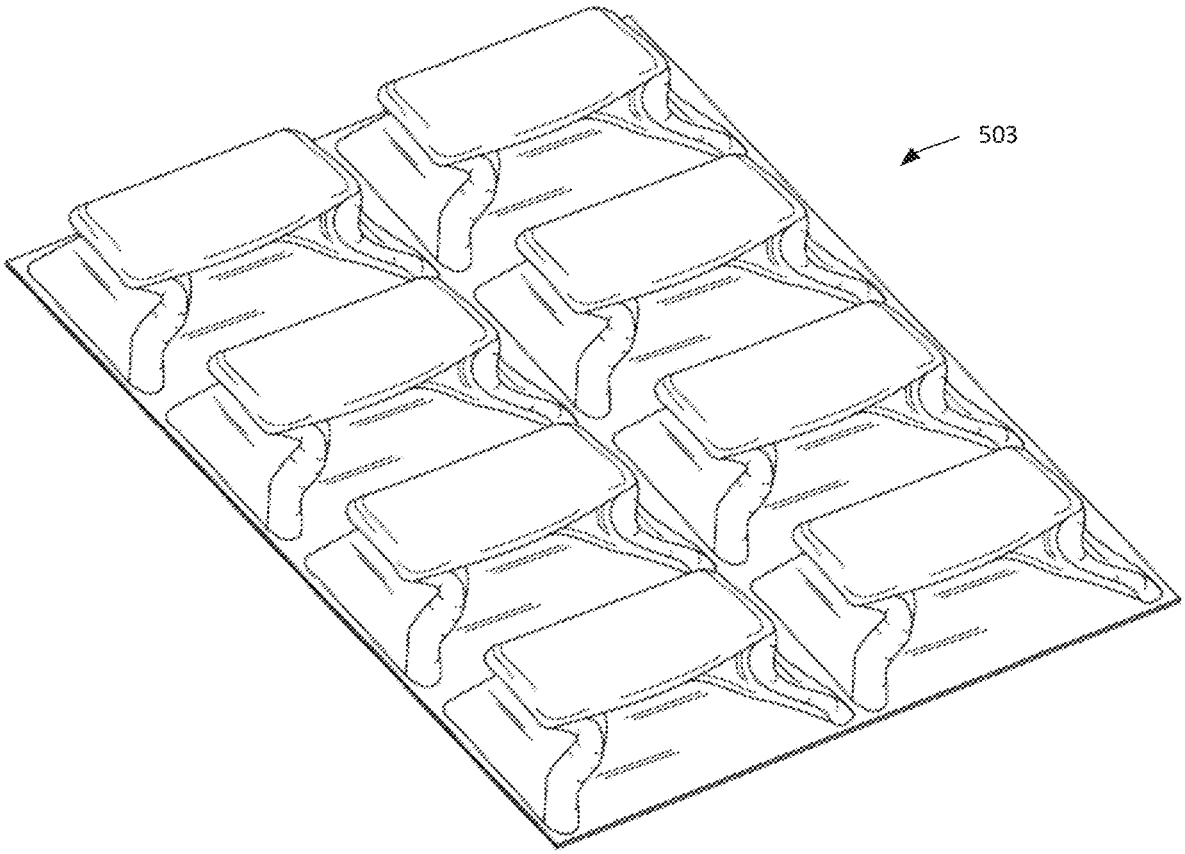
FIG. 9 is an image showing the void form panel of FIG. 6 after being compressed.

In a six-inch void form having a wavelike design like that shown in FIGS. 7 to 9, the void form strength will be broken if the void form is compressed beyond its designed resistance to uplift pressure. At that point, even if the swelling ground retreats and the void form is able to dry out, the void form will have insufficient strength left to transfer energy into the structure above upon further soil upheaval.

FIG. 8 shows a bottom view of a void form panel 503, and shows downward opening cavities 702 that are formed by a first major wall 506, a second major wall 508, a first side wall 510 and a second side wall 511. As can be seen from FIG. 8, the bottom of each of the multiple, repeating cavity subunits are open, allowing the soil beneath the void form panel 503 to expand into the cavities 702.

The shape of cavity subunit 505 exhibits translational symmetry. That is, any cross section of cavity subunit 505 taken between side walls 510 and 511 along a plane perpendicular to the plane of the web and parallel to line 524 will be essentially the same. The translational symmetry provides a preferred failure mode. As the cavity subunit 505 is compressed beyond its designed resistance to uplift pressures, major walls 506 and 508 will collapse on themselves, folding either in a single fold or in multiple folds like an accordion. A cross section of the interior of a cavity subunit 505 taken in a plane parallel to the web will be a rectangle. The size of the rectangle will get smaller as the cross-section plane moves from the web toward the top of the top closure 112. FIG. 9 shows a void form panel 503 that has been compressed beyond its designed resistance to uplift pressures.

Figure 10:
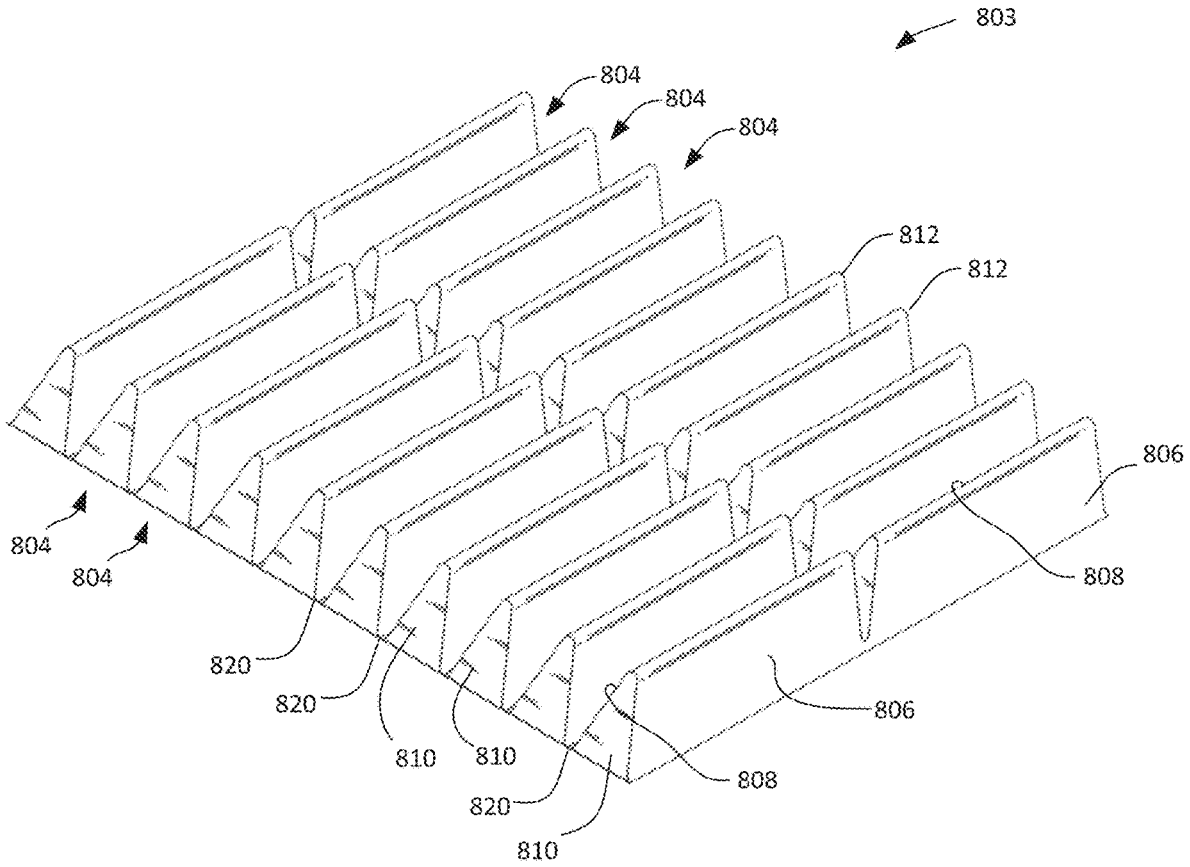
FIG. 10 is a perspective drawing of another void form panel.
Figure 11:
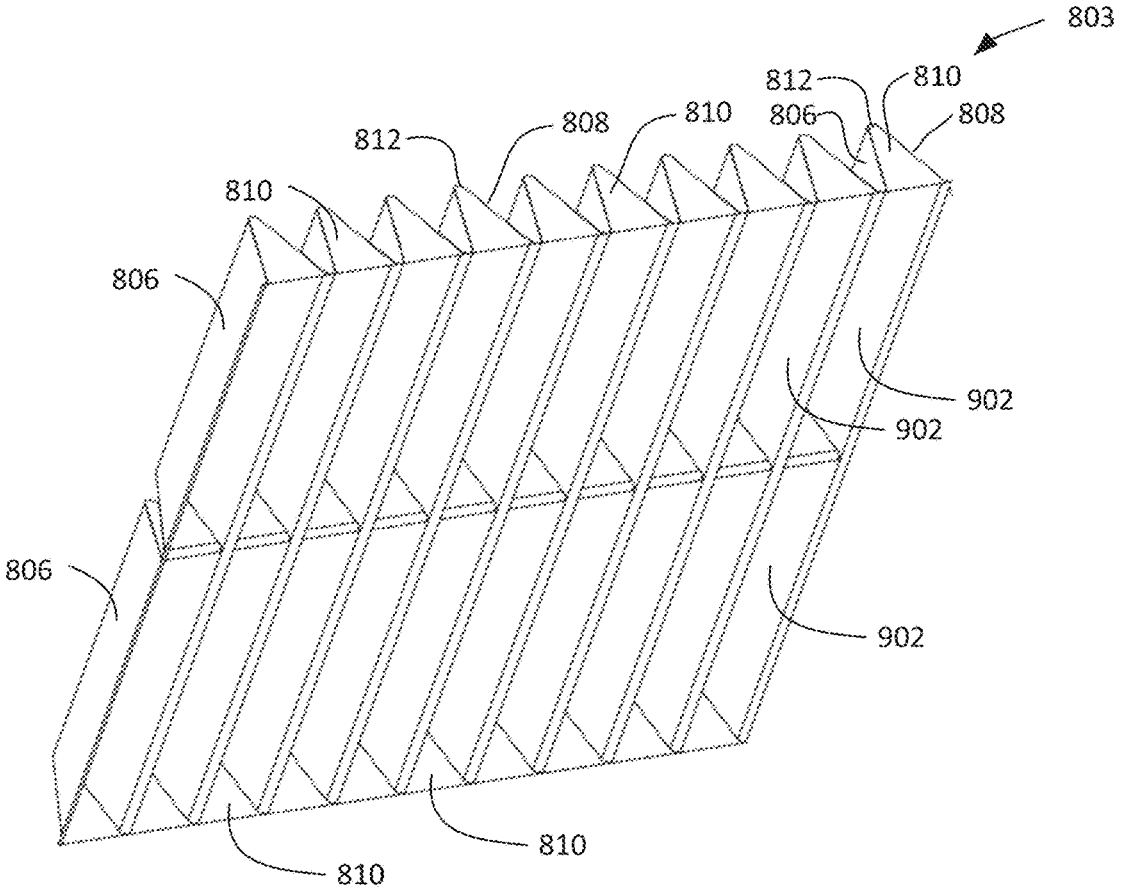
FIG. 11 is a bottom, perspective view of the void form panel of FIG. 10.
Figure 12:
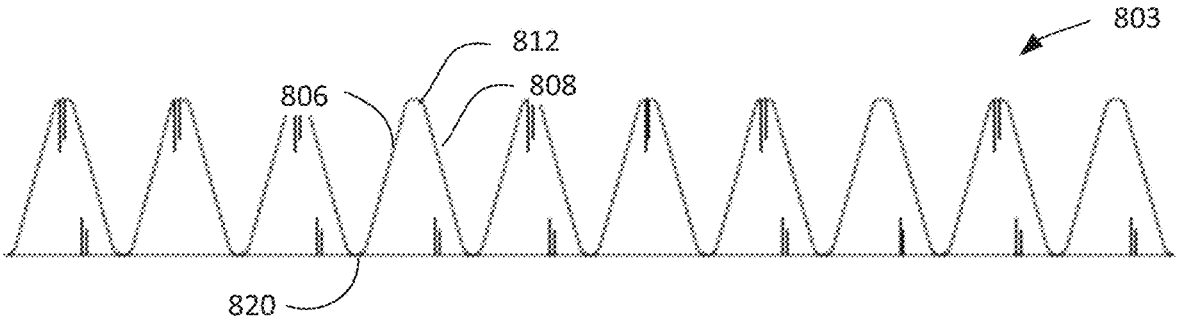
FIG. 12 is a cross-sectional view of the void form panel of FIG. 10.

FIG. 10 shows a void form panel 803 of multiple, repeating cavity subunits 804. Each of the multiple, repeating cavity subunits 804 includes a first major wall 806, a second major wall 808, and two side walls 810. A top closure 812 arcuately closes what would have been a space between first major wall 806 and second major wall 808, which are shown more clearly in FIG. 12. For clarity, only a representative few of the multiple, repeating cavity subunits 804 and their components are labeled. A connecting web 820 holds multiple, repeating cavity subunits 804 together to form void form panel 802. The inclined faces of first major wall 806 and second major wall 808 connect directly or are connected through a connecting portion or top closure 812. Along with the adjacent side walls 810, they form a cavity subunit that is closed at the top and open at the bottom FIG. 11 shows a bottom isometric view of the void form panel of FIG. 10, showing bottom-facing openings 902. FIG. 12 shows a cross-section view of the void form panel of FIG. 10. Upon being compressed beyond their designed resistance to uplift pressures, major walls 506 and 508 will collapse, folding in on themselves as shown in FIG. 9.

FIG. 13 is a partial cross sectional view of two void form panels 103 stacked on the ground 1101 to produce a void space twice the height of a single void form panel 103.

While the embodiments described above include multiple novel and unobvious features, not all embodiments provide all of the features or all of the benefits. For example, a void form that is designed to collapse upon substantial compression can be produced with significantly higher water resistance, whereas a void form having limited water resistance will absorb moisture more readily; it will weaken more quickly and then collapse under lighter compressive loads.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

We claim as follows:

1. A void form panel, comprising:

multiple cavity subunits, each cavity subunit including:

a first inclined major wall;

a second inclined major wall;

a first side wall between the first and second inclined major walls on a first end of the cavity subunit; and a second side wall between the first and second inclined major walls on a second end of the cavity subunit, the first and second side walls being shorter than the first and second inclined major walls, the first and second side walls connected directly to the first and second inclined major walls, the first and second inclined major walls connected through a connecting portion, to close the cavity subunit at a top location and leave the cavity subunit open at a bottom location; and a connecting web connecting the multiple cavity subunits and configured to close gaps between the multiple cavity subunits, and maintain an opening at the bottom location of each of the multiple cavity subunits;

wherein the multiple cavity subunits and the connecting web are formed as a monolithic structure of molded pulp containing approximately 2% to 5% of a water-resistant additive, and wherein the multiple cavity subunits are initially sufficiently strong enough to support a placement of fresh concrete, lose strength upon absorption of moisture, and are open at the bottom location to form a cavity, the cavity, along with the gaps between the multiple cavity subunits, providing space for soil expansion when the void form panel is placed on a ground surface and covered with a spanning substrate material.

2. The void form panel of claim 1, wherein the monolithic structure of molded pulp is produced by a Type 1 pulp molding process.

3. The void form panel of claim 1, wherein the void form is configured to lose at least 40% of its strength when compressed by approximately 20% of its original height.

4. The void form panel of claim 1, wherein the first inclined major wall and the second inclined major wall are connected by an arcuate connecting portion.

5. The void form panel of claim 1, wherein the first inclined major wall and the second inclined major wall are substantially in a shape of a trapezoid.

6. The void form panel of claim 1, wherein the multiple cavity subunits are arranged in an array of rows and columns.

7. The void form panel of claim 1, wherein the connecting web is configured to be severed to facilitate dividing the void form panel into multiple void form segments.

8. The void form panel of claim 7, wherein the connecting web includes a thinned portion to facilitate severing the connecting web portion to create partial void form segments or to facilitate folding the void form panel onto itself to form a taller void form panel.

9. The void form panel of claim 1, wherein the void form panel is configured to be folded in half along the connecting web to produce a taller void form panel having twice a height of the void form panel.

10. A void form panel, comprising:

multiple cavity subunits, each cavity subunit forming a cavity and each cavity subunit having a length along a first direction and a width along a second direction, the length being longer than the width; and a web connecting the multiple cavity subunits at bottom locations of the cavities and configured to close gaps between the multiple cavity subunits;

wherein the multiple cavity subunits and the web are formed as a monolithic structure of molded pulp containing approximately 2% to 5% of a water-resistant additive, and wherein the void form panel is configured to collapse under compression by folding of supporting portions of each cavity subunit in a direction normal to the first direction.

11. The void form panel of claim 10, wherein each of the cavity subunits comprises a set of opposing planar major walls and a set of opposing planar side walls, each of the opposing planar major walls parallel to the first direction and tilted towards each other, and each of the opposing planar side walls parallel to the second direction and tilted towards each other.

12. The void form panel of claim 11 wherein the set of opposing planar side walls connect the set of opposing planar major walls.

13. The void form panel of claim 11, wherein each of the cavity subunits further comprises an arcuate top closure connecting the set of opposing planar walls.

14. The void form panel of claim 10, wherein:

each of the cavity subunits comprises two sets of opposing planar walls, and the void form panel is configured so that upon substantial compression of the void form panel, each cavity subunit collapses by a folding of each opposing planar wall onto itself in a direction normal to its plane.

15. The void form panel of claim 10, wherein the void form panel is configured so that upon compression of the void form panel by approximately 20% of its original height, a compressive strength of the void form panel is decreased by at least 40%.

16. The void form panel of claim 10, wherein the web includes grooves configured to facilitate folding the void form panel onto itself to create a structure having twice a height of the void form panel or to facilitate cutting the void form panel along the web into multiple void form segments, each void form segment having an area smaller than that of the void form panel and containing at least two of the multiple cavity subunits, each void form segment having a resistance to compression substantially the same as the void form panel.

17. The void form panel of claim 10, wherein the void form panel is configured to be folded in half along the web such that the cavities on the two halves face each other and are aligned with each other.

18. A void form panel comprising a first void form panel in accordance with claim 10, folded in half along the web such that the cavities on the two halves of the first void form panel face each other and are aligned with each other, thereby forming a void form panel having twice a height of the first void form panel.

19. A void form panel segment comprising a portion of a first void form panel in accordance with claim 10, having a first number of cavity subunits, the void form panel segment fabricated by cutting the first void form panel such that the void form panel segment has a fewer number of cavity subunits than the first void form panel.

20. A void form panel comprising:

multiple cavity subunits arranged in a repeating pattern, the multiple cavity subunits having sufficient strength to support a working load of placing fresh concrete onto a substrate material covering the void form panel until the concrete sets, the void form panel composed of a monolithic structure of a material configured to absorb moisture and weaken after the concrete has set, the material containing approximately 2% to 5% of a water-resistant additive, the void form panel configured to lose at least 40% of its mechanical strength after being compressed by approximately 20%.

21. The void form panel of claim 20, wherein the void form panel comprises a molded pulp monolithic structure.

22. The void form panel of claim 20, wherein each of the multiple cavity subunits include first and second opposing planar major walls and first and second opposing planar side walls.

23. The void form panel of claim 22, wherein the planar major walls of each cavity subunit are configured to fold in a direction normal to their respective planes as the void form panel is compressed.

24. The void form panel of claim 20, wherein each cavity subunit includes a supporting portion and a connecting portion, the connecting portion configured to maintain the supporting portion in an orientation to resist deformation, such that when the supporting portion is compressed beyond its designed resistance to uplift pressure, the supporting portion folds onto itself and the void form panel collapses when compressed by soil upheaval.

25. The void form panel of claim 24, wherein the supporting portion comprises multiple planar walls, and the connecting portion comprises an arcuate surface connecting the planar walls.

* * * * *